US007874820B2

(12) United States Patent
Shoulders

(10) Patent No.: US 7,874,820 B2
(45) Date of Patent: Jan. 25, 2011

(54) COMPRESSOR UNLOADING VALVE

(75) Inventor: Stephen L. Shoulders, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 768 days.

(21) Appl. No.: 11/719,617

(22) PCT Filed: Feb. 24, 2005

(86) PCT No.: PCT/US2005/006307

§ 371 (c)(1),
(2), (4) Date: May 17, 2007

(87) PCT Pub. No.: WO2006/091200

PCT Pub. Date: Aug. 31, 2006

(65) Prior Publication Data

US 2009/0148332 A1 Jun. 11, 2009

(51) Int. Cl.
*F03C 2/00* (2006.01)
*F03C 4/00* (2006.01)

(52) U.S. Cl. ..... 418/201.2; 418/1; 418/87; 418/180; 418/201.1; 417/282; 417/310; 137/493; 137/493.6; 251/61.4

(58) Field of Classification Search ..... 418/201.2, 418/201.1, 180, 87, 1; 417/282, 310, 440; 251/61.4; 137/493, 493.6
See application file for complete search history.

(56) References Cited

U.S. PATENT DOCUMENTS

| | | | | |
|---|---|---|---|---|
| 1,995,561 | A * | 3/1935 | Belanger et al. | 251/63.6 |
| 3,632,231 | A * | 1/1972 | Bloom | 417/295 |
| 4,727,725 | A * | 3/1988 | Nagata et al. | 418/201.2 |
| 6,494,699 | B2 * | 12/2002 | Sjoholm et al. | 418/201.2 |

FOREIGN PATENT DOCUMENTS

| | | | |
|---|---|---|---|
| GB | 2119445 | A * | 11/1983 |
| JP | 02207187 | A * | 8/1990 |
| JP | 02248677 | A * | 10/1990 |
| JP | 05157072 | A * | 6/1993 |
| JP | 09079166 | A * | 3/1997 |

* cited by examiner

*Primary Examiner*—Theresa Trieu
(74) *Attorney, Agent, or Firm*—Bachman & LaPointe, P.C.

(57) ABSTRACT

A compressor apparatus (20) has a housing (22) having first (53) and second (58) ports along a flow path. One or more working elements (26; 28) cooperate with the housing (22) to define a compression path between suction (60) and discharge (62) locations along the flow path. An unloading valve (100) has a valve element (102) having a range between a first condition and a second condition, the second condition being unloaded relative to the first condition. Means (120, 160) bias the valve element toward a third condition intermediate the first and second conditions.

22 Claims, 5 Drawing Sheets

COMPRESSOR UNLOADING VALVE

BACKGROUND OF THE INVENTION

The invention relates to compressors. More particularly, the invention relates to refrigerant compressors.

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor or vice versa.

When one of the interlobe spaces is exposed to an inlet port, the refrigerant enters the space essentially at suction pressure. As the rotors continue to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port.

It is often desirable to temporarily reduce the refrigerant mass flow through the compressor by delaying the closing off of the inlet port (with or without a reduction in the compressor volume index) when full capacity operation is not required. Such unloading is often provided by a slide valve having a valve element with one or more portions whose positions (as the valve is translated) control the respective suction side closing and discharge side opening of the compression pockets. The primary effect of an unloading shift of the slide valve is to reduce the initial trapped suction volume (and hence compressor capacity); a reduction in volume index is a typical side effect. Exemplary slide valves are disclosed in U.S. Patent Application Publication No. 20040109782 A1 and U.S. Pat. Nos. 4,249,866 and 6,302,668. The desired degree to which a compressor may be unloaded is often application-specific. High degrees of unloading (e.g., down to an exemplary 15% of full load capacity) may be preferred for some applications.

SUMMARY OF THE INVENTION

According to one aspect of the invention, a compressor has housing having first and second ports along a flow path. One or more working elements cooperate with the housing to define a compression path between suction and discharge locations along the flow path. An unloading valve has a valve element having a range between a first condition and a second condition, the second condition being unloaded relative to the first condition. Means bias the valve element toward a third condition intermediate the first and second conditions.

In various implementations, the means may comprise a first and second springs. The springs may be on opposite sides of a piston engaged to the valve element.

The means may be introduced in a reengineering of an existing compressor configuration and/or a remanufacturing of an existing compressor. The reengineering may be an iterative process performed on hardware or as a simulation/calculation. The reengineering or remanufacturing may comprise adding a second spring to act against an existing first spring of the baseline compressor.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
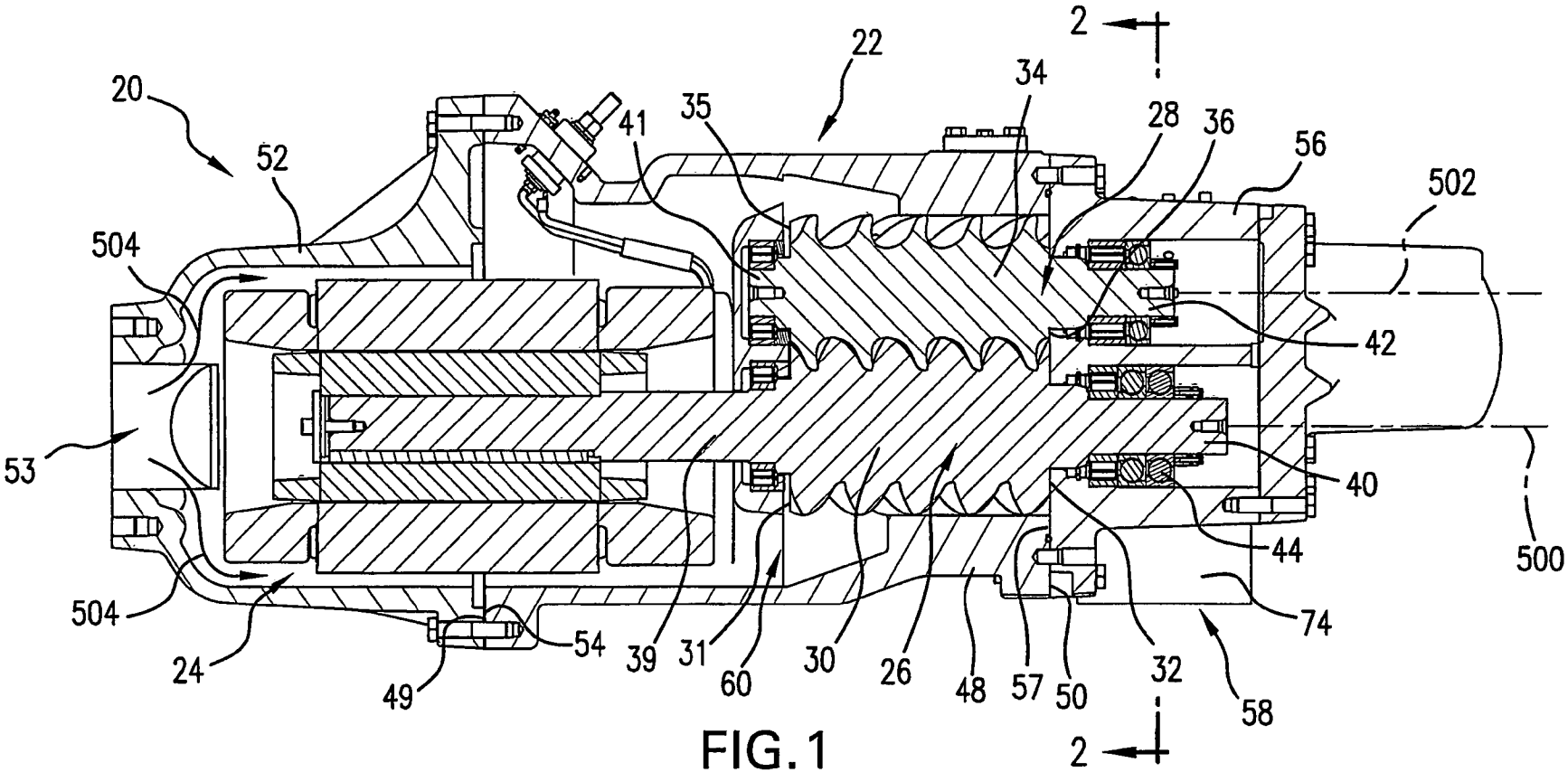
FIG. 1 is a longitudinal sectional view of a compressor.

FIG. 1 shows a compressor 20 having a housing assembly 22 containing a motor 24 driving rotors 26 and 28 having respective central longitudinal axes 500 and 502. In the exemplary embodiment, the rotor 26 has a male lobed body or working portion 30 extending between a first end 31 and a second end 32. The working portion 30 is enmeshed with a female lobed body or working portion 34 of the female rotor 28. The working portion 34 has a first end 35 and a second end 36. Each rotor includes shaft portions (e.g., stubs 39, 40, 41, and 42 unitarily formed with the associated working portion) extending from the first and second ends of the associated working portion. Each of these shaft stubs is mounted to the housing by one or more bearing assemblies 44 for rotation about the associated rotor axis.

In the exemplary embodiment, the motor is an electric motor having a rotor and a stator. One of the shaft stubs of one of the rotors 26 and 28 may be coupled to the motor's rotor so as to permit the motor to drive that rotor about its axis. When so driven in an operative first direction about the axis, the rotor drives the other rotor in an opposite second direction. The exemplary housing assembly 22 includes a rotor housing 48 having an upstream/inlet end face 49 approximately midway along the motor length and a downstream/discharge end face 50 essentially coplanar with the rotor body ends 32 and 36. Many other configurations are possible.

The exemplary housing assembly 22 further comprises a motor/inlet housing 52 having a compressor inlet/suction port 53 at an upstream end and having a downstream face 54 mounted to the rotor housing downstream face (e.g., by bolts through both housing pieces). The assembly 22 further includes an outlet/discharge housing 56 having an upstream face 57 mounted to the rotor housing downstream face and having an outlet/discharge port 58. The exemplary rotor housing, motor/inlet housing, and outlet housing 56 may each be formed as castings subject to further finish machining.

Figure 2:
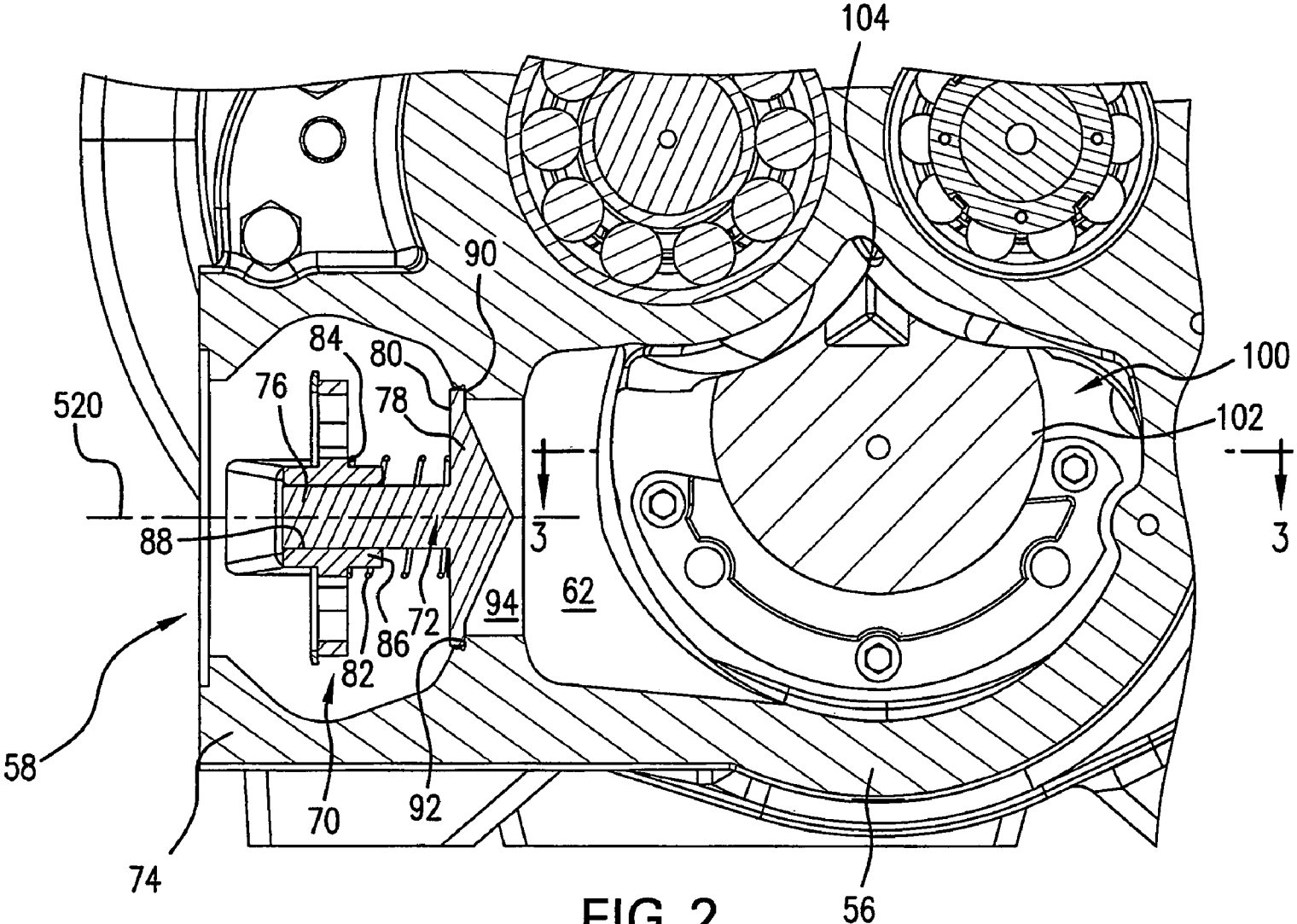
FIG. 2 is a transverse sectional view of a discharge plenum of the compressor of FIG. 1, taken along line 2-2.

Surfaces of the housing assembly 22 combine with the enmeshed rotor bodies 30 and 34 to define inlet and outlet ports to compression pockets compressing and driving a refrigerant flow 504 from a suction (inlet) plenum 60 to a discharge (outlet) plenum 62 (FIG. 2). A series of pairs of male and female compression pockets are formed by the housing assembly 22, male rotor body 30 and female rotor body 34. Each compression pocket is bounded by external surfaces of enmeshed rotors, by portions of cylindrical surfaces of male and female rotor bore surfaces in the rotor case and continuations thereof along a slide valve, and portions of face 57.

FIG. 2 shows further details of the exemplary flowpath at the outlet/discharge port 58. A check valve 70 is provided having a valve element 72 mounted within a boss portion 74 of the outlet housing 56. The exemplary valve element 72 is a front sealing poppet having a stem/shaft 76 unitarily formed with and extending downstream from a head 78 along a valve axis 520. The head has a back/underside surface 80 engaging an upstream end of a compression bias spring 82 (e.g., a metallic coil). The downstream end of the spring engages an upstream-facing shoulder 84 of a bushing/guide 86. The bushing/guide 86 may be unitarily formed with or mounted relative to the housing and has a central bore 88 slidingly accommodating the stem for reciprocal movement between an open condition (not shown) and a closed condition of FIG. 2. The spring 82 biases the element 72 upstream toward the closed condition. In the closed condition, an annular peripheral seating portion 90 of the head upstream surface seats against an annular seat 92 at a downstream end of a port 94 from the discharge plenum.

For capacity control/unloading, the compressor has a slide valve 100 having a valve element 102. The valve element 102 has a portion 104 along the mesh zone between the rotors (i.e., along the high pressure cusp). The exemplary valve element has a first portion 106 (FIG. 3) at the discharge plenum and a second portion 108 at the suction plenum. The valve element is shiftable to control compressor capacity to provide unloading. The exemplary valve is shifted via linear translation parallel to the rotor axes.

Figure 3:
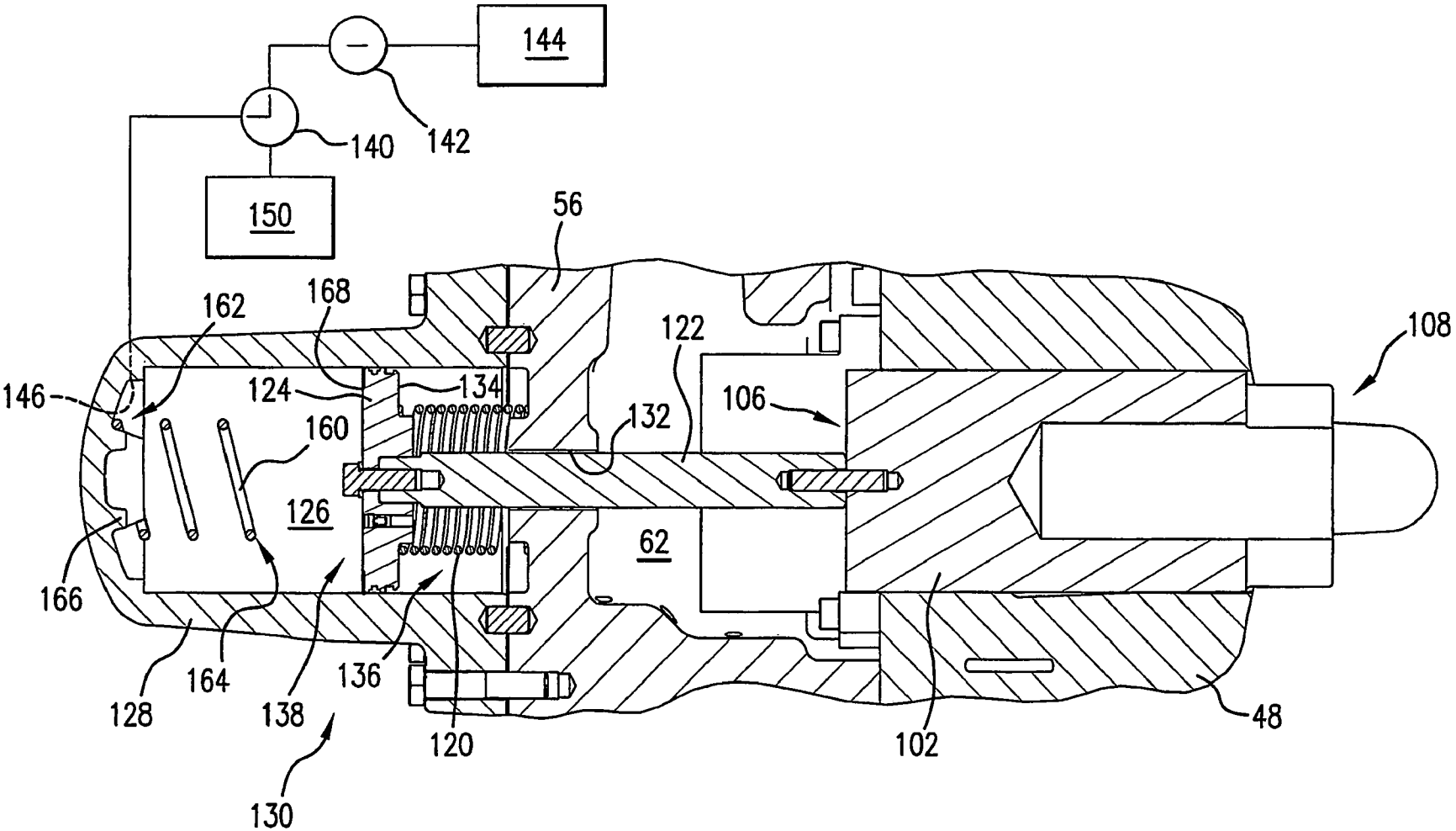
FIG. 3 is a sectional view of a slide valve assembly of the discharge plenum of FIG. 2 in a fully loaded condition, taken along line 3-3.
Figure 4:
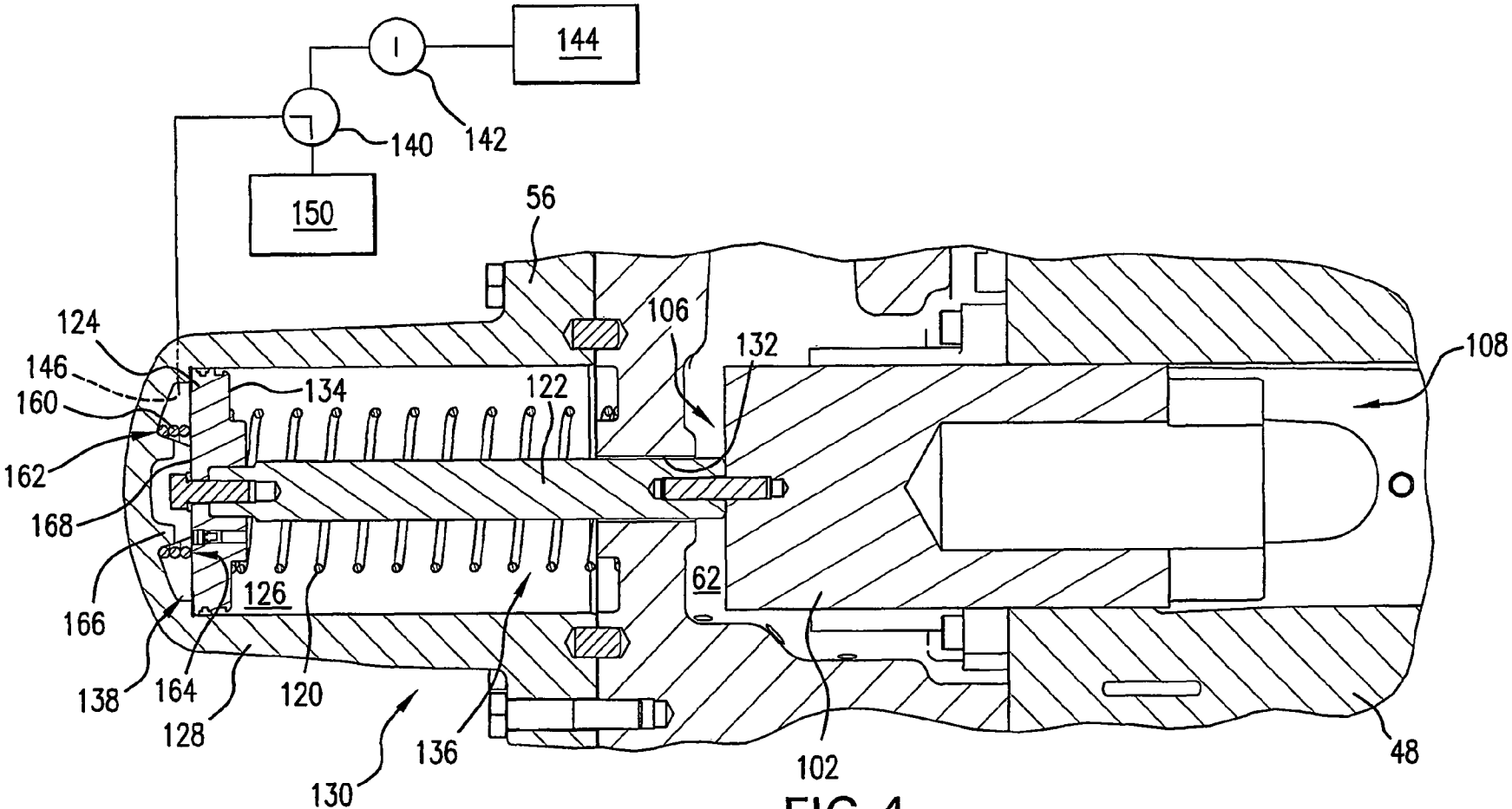
FIG. 4 is a view of the slide valve of FIG. 3 in a relatively unloaded condition.

FIG. 3 shows the valve element at an upstream-most position in its range of motion In this position, the compression pockets close relatively upstream and capacity is a relative maximum (e.g., at least 90% of a maximum displacement volume for the rotors, and often about 99%). FIG. 4 shows the valve element shifted to a downstream-most position. Capacity is reduced in this unloaded condition (e.g., to a displacement volume typically less than 40% of the FIG. 3 displacement volume or the maximum displacement volume, and often less than 30%). In the exemplary slide valve, shifts between the two positions are driven by a combination of spring force and fluid pressure. A main spring 120 biases the valve element from the loaded to the unloaded positions. In the exemplary valve, the spring 120 is a metal coil spring surrounding a shaft 122 coupling the valve element to a piston 124. The piston is mounted within a bore (interior) 126 of a cylinder 128 formed in a slide case element 130 attached to the outlet case. The shaft passes through an aperture 132 in the outlet case. The spring is compressed between an underside 134 of the piston and the outlet case. A proximal portion 136 of the cylinder interior is in pressure-balancing fluid communication with the discharge plenum via clearance between the aperture and shaft. A headspace 138 is coupled via electronically-controlled solenoid valves 140 and 142 (shown schematically) to a high pressure fluid source 144 at or near discharge conditions (e.g., to an oil separator). A port 146 is schematically shown in the cylinder at the headspace at the end of a conduit network connecting the valves 140 and 142. In an exemplary implementation, the portions of the conduit network may be formed within the castings of the housing components. The exemplary main spring 120 acts with a force that is relatively insignificant in comparison to the net force which may developed by fluid pressures. During periods of non-operation, when fluid pressures are balanced, the main spring 120 acts as is described below.

The loaded position/condition of FIG. 3 can be achieved by coupling the headspace 138 to the source 144 and isolating it from drain/sink 150 by appropriate control of valves 140 and 142. The unloaded position/condition of FIG. 4 can be achieved by coupling the headspace 138 to the drain/sink 150 and isolating it from source 144 by appropriate control of valves 140 and 142. Intermediate (partly loaded) positions, not shown, can be achieved by alternating connection of headspace 138 to either the source 144 or the drain/sink 150 using appropriately chosen spans of time for connection to each, possibly in combination with isolating the headspace 138 from both source 144 and drain/sink 150 for an appropriately chosen span of time (e.g., via appropriate modulation techniques).

For some applications it is desirable to have the unloaded position/condition of FIG. 4 be such that during operation the refrigerant mass flow through the compressor is as low as an exemplary 15% of the mass flow achieved when the slide valve is in the loaded position/condition of FIG. 3. Said another way, the displacement volume of the position of FIG. 4 would be an exemplary 15-20% of the displacement volume of the position of FIG. 3. The displacement volume slightly above 15% would achieve the 15% flow rate due to internal leakage. At some start-up conditions, low rates of refrigerant mass flow may result in discharge pressure may not rising in a relatively short period of time. Many systems depend on discharge pressure in source 144 to deliver oil for actuating slide valve 100 as previously described and for lubricating rotors and bearings. An inability to rapidly develop adequate discharge pressure to accomplish these roles may be viewed as having a negative impact on system performance or may be detrimental to compressor reliability. The problem may be particularly serious when the system is started after it has not operated for a long period of time. In such situations, residual lubrication on rotors and in bearing cavities may be substantially diluted, owing to the tendency of many refrigeration oils to absorb refrigerant over time and thereby become diluted. During operation, this dilution tendency is countered by elevated temperatures and by high speed motion of parts, both of which tend to move refrigerant out of solution with oil. During a start-up after a long shutdown period it is therefore desirable to quickly deliver lubricant to the compressor.

To provide rapid start-up it is desirable that the valve position at start-up be more loaded than the unloaded position of FIG. 4. Preferably, the start-up position would correspond to a mass flow rate that is in the range of 25-35% of that of the loaded position of FIG. 3. A displacement volume might be 25-50% that of FIG. 3.

According to the present invention, means are provided for biasing the slide valve from the unloaded end of its range (FIG. 4) at least partially toward the loaded end of its range (FIG. 3). An exemplary means includes a spring 160. An exemplary spring 160 is a compression coil spring within the headspace 138. The exemplary spring 160 extends from a proximal end portion 162 to a distal end portion 164. The proximal end portion 162 is engaged to a boss 166 of the valve case 130 in the headspace to securely retain the spring 160.

The exemplary spring 160 has dimensions and a spring constant such that the distal end 164 engages the face 168 of the piston 124 in the FIG. 4 unloaded condition but disengages at some point in the range of travel to the FIG. 3 loaded condition.

The spring 160 may come into play, for example, during a shutdown condition. For example, in a shutdown condition, pressures may equalize in the suction plenum 60, discharge plenum 62, cylinder interior proximal portion 136, and headspace 138. In such a condition, the spring 160 will act to shift the valve element slightly away from the FIG. 4 unloaded condition (e.g., to an intermediate condition of FIG. 5). At shutdown, when pressures on each side of the piston are equal, spring 160 acts on piston 124 in opposition to spring 120, moving piston 124 and attached slide valve 100 to the position of FIG. 5 which is slightly more loaded than that of FIG. 4. The length and spring constant of spring 160 are chosen, possibly in combination with those of spring 120, so that the resulting position shown in FIG. 5 corresponds to a displacement volume that results in discharge pressure rising rapidly enough to ensure quick delivery of lubricant to the compressor. The displacement volume corresponding to the position of FIG. 5 would typically be in the range of 25-35% of that of the loaded position of FIG. 3. After start-up, once discharge pressure has risen, the unloaded position of FIG. 4 can automatically be achieved because the action of pressures acting on faces 168 and 134 of piston 124 and on sides 106 and 108 of slide valve 100 generates sufficient force to overcome the force provided by spring 160. Alternatively, if desired, the unloaded position of FIG. 4 can be prevented by coupling headspace 138 to source 144 as previously described as adequate pressure in source 144 has now been developed to allow delivery of fluid to headspace 138.

The spring 160 may be added in a reengineering or remanufacturing from a baseline compressor or configuration thereof. In the baseline, the main spring 160 could have sufficient length so that start-up would be in the fully unloaded condition. The main spring 160 may be preserved or modified in the reengineering or remanufacturing. One modification would be to shorten it.

Figure 5:
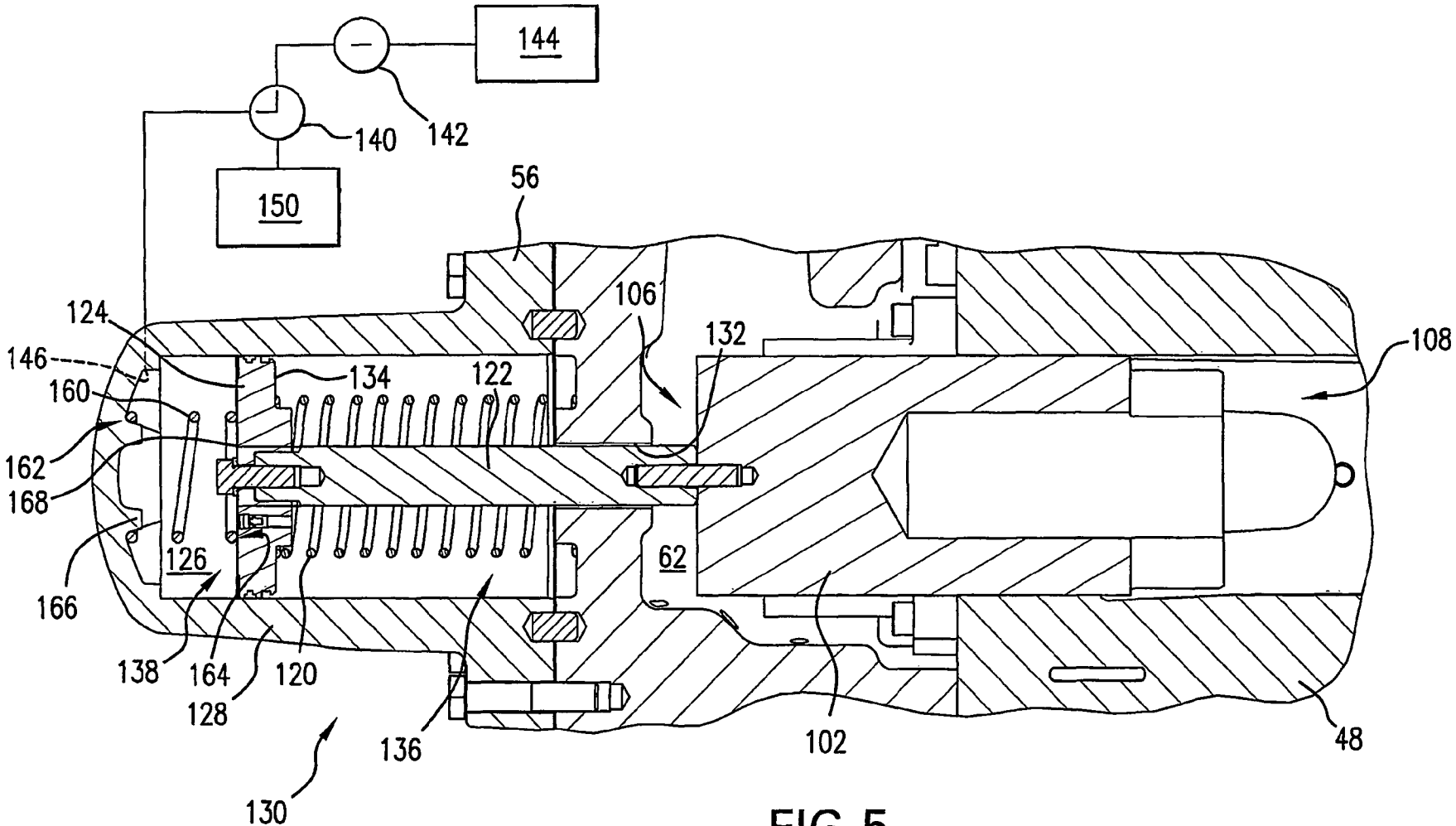
FIG. 5 is a view of the slide valve of FIG. 3 in a neutral condition more loaded than the FIG. 4 condition and less loaded than the FIG. 3 condition.

Among many alternatives to a headspace compression spring 160 would be to have the main spring 120 be neutral at the FIG. 5 valve condition and go into tension between the FIG. 4 and FIG. 5 valve conditions. Rather than a coil spring, the spring 160 could be another form of spring (e.g., a Belleville washer spring). In another embodiment, the spring 160 could be attached to piston 124 rather than to boss 166 of valve case 130.

One or more embodiments of the present invention have been described. Nevertheless, it will be understood that various modifications may be made without departing from the spirit and scope of the invention. For example, in a reengineering or remanufacturing situation, details of the existing compressor configuration may particularly influence or dictate details of the implementation. Accordingly, other embodiments are within the scope of the following claims.

What is claimed is:

1. A compressor apparatus (20) comprising:

a housing (22) having first (53) and second (58) ports along a flow path;

one or more working elements (26; 28) cooperating with the housing (22) to define a compression path between suction (60) and discharge (62) locations along the flow path; and an unloading valve (100) having:

a valve element (102) having a portion (104) along a mesh zone between the working elements and being shiftable via linear translation parallel to axes of rotation of the one or more working elements and having a range between a first condition and a second condition, the second condition being unloaded relative to the first condition; and, means (160) biasing the valve element toward a third condition intermediate the first and second conditions in displacement volume, the biasing being from both the first condition and the second condition.

2. The apparatus of claim 1 wherein:

the unloading valve (100) is a slide valve and the range is a range of linear translation;

the first, second, and third conditions respectively are associated with first, second, and third valve element positions, the third valve element position being closer to the second valve element position than to the first valve element position.

3. The apparatus of claim 2 wherein:

the first valve element position has a first displacement volume;

the second valve element position has a second displacement volume of 15-20% of the first displacement volume; and the third valve element position has a third displacement volume of 25-35% of the first displacement volume.

4. The apparatus of claim 2 wherein the third valve element position is 5-25% of said range from said second valve element position to said first valve element position.

5. The apparatus of claim 2 wherein the unloading valve further comprises:

a cylinder (128);

a piston (124) in the cylinder and mechanically coupled to the valve element (102); and a control valve (140; 142) coupled to a headspace (138) of the cylinder to selectively expose the headspace to a fluid (144) source.

6. The apparatus of claim 5 wherein the means comprises:

a first spring (120) biasing the valve element from the first condition toward the third condition; and a second spring (160) biasing the valve element from the second condition toward the third condition.

7. The apparatus of claim 6 wherein the means comprises:

the first spring (120) is a first coil spring and surrounds a shaft (122), the shaft coupling the piston (124) to the valve element (102); and a second spring (160) is a second coil spring and is in the headspace (138).

8. The apparatus of claim 1 wherein the means comprises:

a first spring (120) biasing the valve element from the first condition toward the third condition; and a second spring (160) biasing the valve element from the second condition toward the third condition.

9. The apparatus of claim 8 wherein:

the first spring (120) has a lower spring constant than does the second spring (160).

10. The apparatus of claim 8 wherein:

the first spring (120) is under compression when the valve element is along an entirety of said range; and the second spring (160) is under compression at least when said valve element is everywhere between said second and third conditions.

11. The apparatus of claim 8 wherein:

the first (120) and second (160) springs are metallic coil springs.

12. The compressor of claim 1 wherein the one or more working elements include:

a male-lobed rotor (26) having a first rotational axis (500); and a female-lobed rotor (28) having a second rotational axis (502) and enmeshed with the first rotor.

13. The compressor of claim 12 wherein:

in the first condition, the compressor is at least at 90% of a maximum displacement volume;

in the second condition, the compressor is at less than 20% of the first condition displacement volume; and in the third condition, the compressor is at 25-50% of the first condition displacement volume.

14. The compressor of claim 12 wherein:

in the first condition, the compressor is at least at 90% of a maximum displacement volume;

in the second condition, the compressor is at less than 20% of the first condition displacement volume; and in the third condition, the exceeds the second condition displacement volume by 10-40% of said first condition displacement volume.

15. A compressor apparatus (20) comprising:

a housing (22) having first (53) and second (58) ports along a flow path;

one or more working elements (26; 28) cooperating with the housing (22) to define a compression path between suction (60) and discharge (62) locations along the flow path; and an unloading valve (100) having:

a valve element (102) having a portion (104) along a mesh zone between the working elements and being shiftable via linear translation parallel to axes of rotation of the one or more working elements and having a range between a first condition and a second condition, the second condition being unloaded relative to the first condition; and a first spring (120) biasing the valve element from the first condition toward a third condition intermediate the first and second conditions in displacement volume; and a second spring (160) biasing the valve element from the second condition toward the third condition.

16. The apparatus of claim 15 wherein:

the first spring (120) has a lower spring constant than does the second spring (160).

17. The apparatus of claim 15 wherein:

the first spring (120) is under compression when the valve element is along an entirety of said range; and the second spring (160) is under compression at least when said valve element is everywhere between said second and third conditions.

18. The apparatus of claim 15 wherein:

the first (120) and second (160) springs are metallic coil springs.

19. A method for remanufacturing a compressor (20) or reengineering a configuration of the compressor comprising:

providing an initial such compressor or configuration having:

a housing (22);

one or more working elements (26; 28) cooperating with the housing to define a compression path between suction (60) and discharge (62) locations; and an unloading slide valve (100) having:

a valve element (102) having a portion (104) along a mesh zone between the working elements and being shiftable via linear translation parallel to axes of rotation of the one or more working elements and having a range between a first condition and a second condition, the second condition being unloaded relative to the first condition;

a cylinder (128);

a piston (124) in the cylinder and mechanically coupled to the valve element; and a fluid in a headspace (138) of the cylinder, pressure of the fluid in the headspace producing a force on the piston and valve element in a direction from the second condition toward the first condition; and adapting such compressor or configuration to include means (160) biasing the valve element toward a third condition from said second condition, the third condition being intermediate the first and second conditions in displacement volume.

20. The method of claim 19 wherein:

the adapting includes selecting at least one parameter of the means to provide a desired neutral location of said valve element.

21. The method of claim 20 wherein the selecting comprises an iterative:

varying of said at least one parameter; and directly or indirectly determining a neutral location of said valve element.

22. The method of claim 21 wherein:

the varying comprises varying a property of a compression spring (160) in the headspace (138).

* * * * *